US005613253A

United States Patent [19]

Rose

[11] Patent Number: 5,613,253

[45] Date of Patent: Mar. 25, 1997

[54] APPARATUS FOR PREVENTING BED FRAME SQUEAKING

[76] Inventor: Jean M. Rose, 1155 E. Stanley Rd., Mount Morris, Mich. 48458

[21] Appl. No.: 628,528

[22] Filed: Apr. 5, 1996

[51] Int. Cl.[6] ..... A47C 21/00

[52] U.S. Cl. ..... 5/309

[58] Field of Search ..... 5/658, 309, 288

[56] References Cited

U.S. PATENT DOCUMENTS

| | | | |
|---|---|---|---|
| 97,619 | 12/1869 | Dugan | 5/309 |
| 474,018 | 5/1892 | Laliberte | 5/309 |
| 622,889 | 4/1899 | Forsyth | 5/309 |
| 2,869,148 | 1/1959 | Freelander | 5/309 |
| 3,426,370 | 2/1969 | Underdown | 5/309 |
| 5,029,648 | 7/1991 | Stephens | 168/12 |

*Primary Examiner*—Flemming Saether

[57] ABSTRACT

Bed shims comprise a plurality of bed shim units including flexible front and rear plates and a rigid central plate, the plates being secured together, the rear plate having a flat surface including a peel-off adhesive backing, each bed shim unit includes two circular holes extending therethrough, two parallel longitudinal perforations extending between the circular holes of each bed shim unit, the parallel longitudinal perforations defining a generally rectangular area between the circular holes, the generally rectangular area of each bed shim unit adapted to be punched out to define a generally oval shaped hole extending therethrough.

4 Claims, 3 Drawing Sheets

Fig. 5
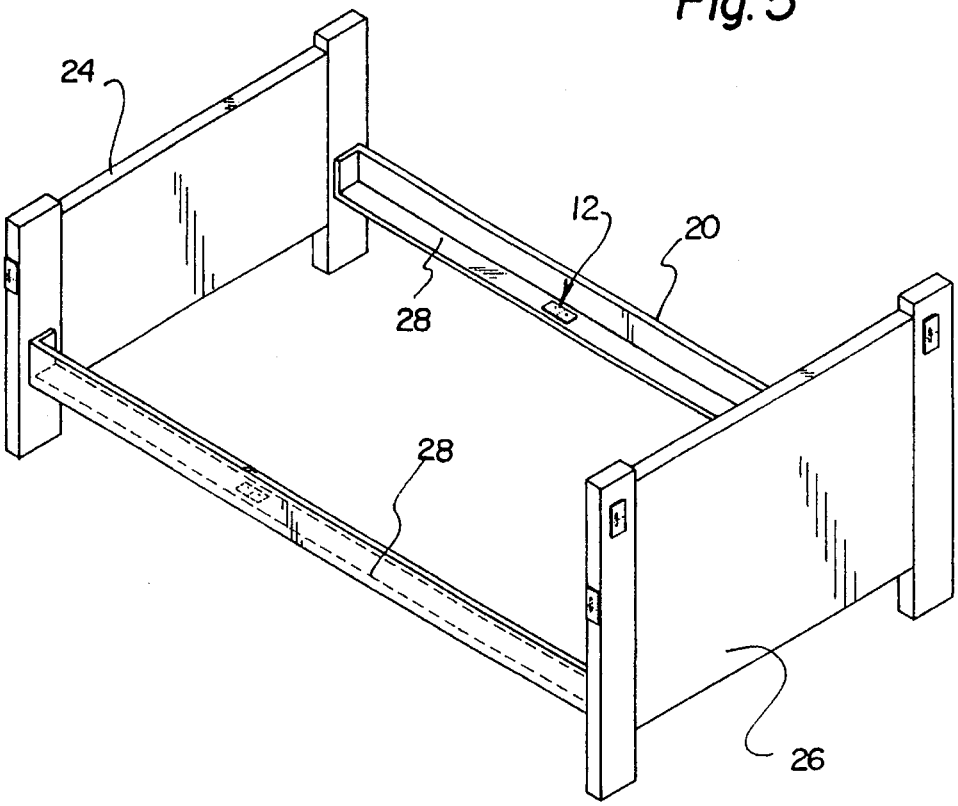
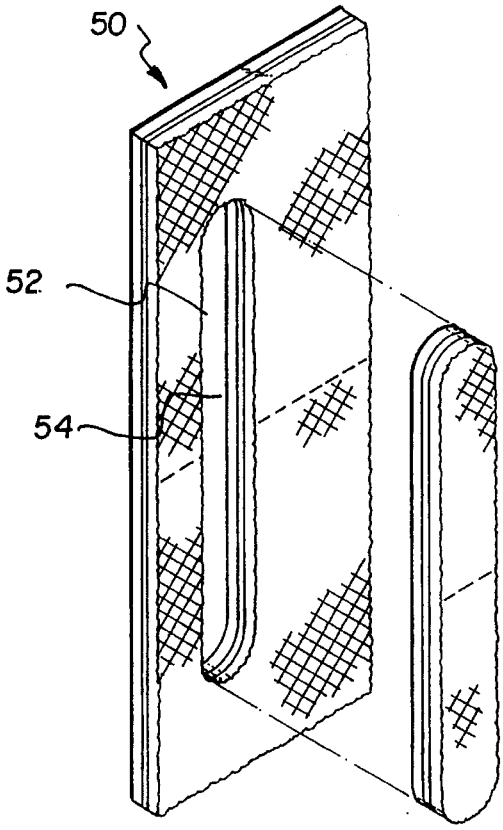
Fig. 6

It is a further object of the present invention to provide a new and improved bed shims which is of durable and reliable construction.

An even further object of the present invention is to provide a new and improved bed shims which is susceptible of a low cost of manufacture with regard to both materials and labor, and which accordingly is then susceptible of low prices of sale to the consuming public, thereby making such bed shims economically available to the buying public.

Still yet another object of the present invention is to provide a new and improved bed shims which provides in the apparatuses and methods of the prior art some of the advantages thereof, while simultaneously overcoming some of the disadvantages normally associated therewith.

Even still another object of the present invention is to provide a new and improved bed shims for affixing bed shim units to various locations on a bed frame to eliminate squeaking and protect wall surfaces.

Lastly, it is an object of the present invention to provide a new and improved bed shims comprise a plurality of bed shim units including flexible front and rear plates and a rigid central plate, the plates being secured together, the rear plate having a flat surface including a peel-off adhesive backing, each bed shim unit includes two circular holes extending therethrough, two parallel longitudinal perforations extending between the circular holes of each bed shim unit, the parallel longitudinal perforations defining a generally rectangular area between the circular holes, the generally rectangular area of each bed shim unit adapted to be punched out to define a generally oval shaped hole extending therethrough.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 discloses the various locations where bed shim units can be positioned on a bed frame and headboard.

FIG. 6 is an isolated perspective view of a bed shim unit illustrating the perforated slot removed from the remainder of the unit.

The same reference numerals refer to the same parts through the various Figures.

DESCRIPTION OF THE PREFERRED EMBODIMENT

Figure 1:
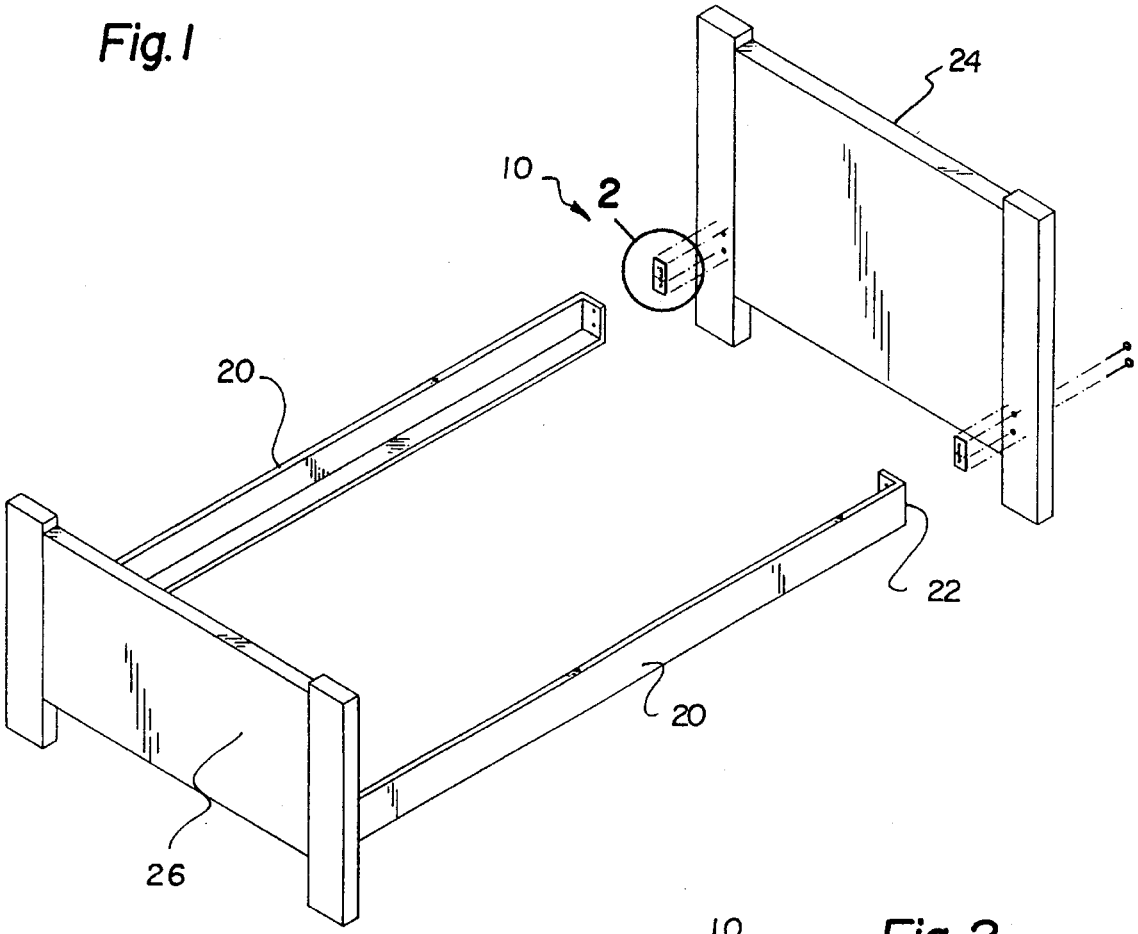
FIG. 1 is a perspective view of the preferred embodiment of the bed shims constructed in accordance with the principles of the present invention.

With reference now to the drawings, and in particular, to FIG. 1 thereof, the preferred embodiment of the new and improved bed shims embodying the principles and concepts of the present invention and generally designated by the reference number 10 will be described.

Specifically, it will be noted in the various Figures that the device relates to bed shims which include a plurality of bed shim units. The bed shim units are adapted to be affixed to various locations on a bed frame to eliminate squeaking and protect wall surfaces. In its broadest context, the device 10 consists of bed shim units 12, a central perforation 14 and a longitudinal perforation 16. Such components are individually configured and correlated with respect to each other so as to attain the desired objective.

Bed shims 10 are adapted for use in association with a bed frame which includes parallel rails 20 having ends 22, a head board 24, a foot board 26 and a plurality of bolts. In alternate embodiments bed shims 10 are utilized with a plurality of other types of bed frame structures. In an operative orientation bed shims are placed between the ends 22 of the rails and headboard 24 to stop the annoying squeaking and creaking caused by parts of the bed frame and headboard rubbing against each other. Bed shims can also be placed on the side and rear portions of a headboard to serve as headboard bumpers to protect wall surfaces. Bed shims may also be placed on the side and rear portions of a foot board 26 and upper surface 28 of the bed frame rails. Note FIGS. 1 and 5.

Figure 3:
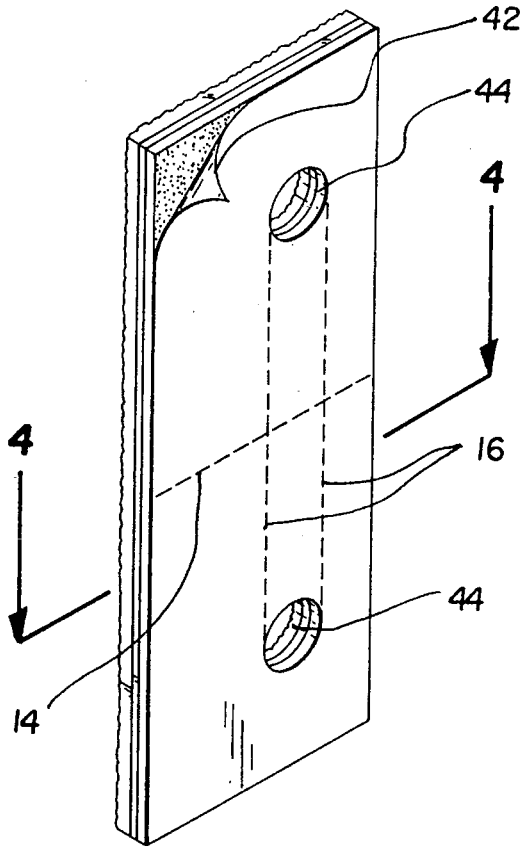
FIG. 3 is an isolated perspective view of a bed shim unit illustrating the peel-off adhesive backing on its rear surface.
Figure 4:
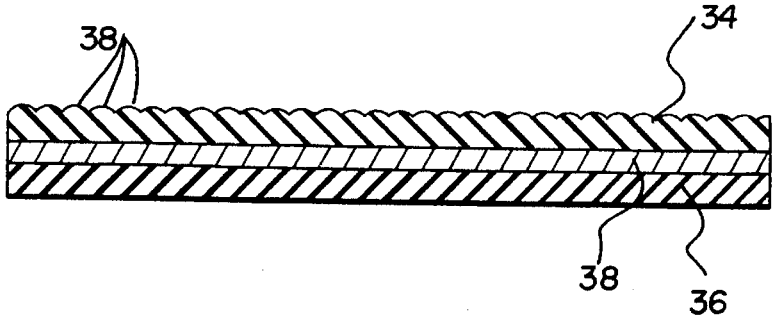
FIG. 4 is a cross sectional view of a bed shim unit taken along section line 4—4 of FIG. 3.

A plurality of bed shim units 12 are each formed in a planar rectangular configuration. In the preferred embodiment the bed shim units have long side edges 30 measuring 4 inches and short side edges 32 measuring 1½ inches. Each bed shim unit includes flexible front 34 and rear 36 plates fabricated of NEOPRENE and a rigid central plate 38 fabricated of aluminum. The central plate provides strength and rigidity to the bed shim units. Each plate has parallel first and second long side edges and parallel short side edges. Each plate has a height of 4 inches, a width of 1½ inches and a thickness of 1/16 inch. In an operative orientation the plates are secured together with the corresponding side edges in alignment. The total thickness of each bed shim unit is 3/16 of an inch. Note FIGS. 3 and 4.

The front 34 and rear 36 plates are fabricated of NEOPRENE. In alternate embodiments of the apparatus the front and rear plates are fabricated of other elastomeric materials. The front surface of the front plate is checkered and includes a plurality of pyramid shaped bumps 38 separated by generally linear channels 40. The bumps allow bed shim units to couple flush with uneven mounting surfaces. The rear plate has a flat surface which includes a peel-off adhesive backing 42. The peel-off backing provides an efficient coupling method for the bed shim units. The NEOPRENE front and rear surfaces of the bed shim units function to reduce noise and scratching. Note FIGS. 3 and 4.

Each bed shim unit includes two ⅜ inch diameter circular holes 44 which extend through each of the plates. The center point of each circular hole is positioned ¾ inch from each short side edge. The holes permit the passage of bolt or screw through the bed shim units. Each circular hole is positioned about ½ inch from the first long side edge of each plate. A central perforation 14 extends from the center point of the first long side edge to the center point of the second long side edge of each plate. The central perforation permits a user to divide each bed shim unit into two separate, equally

APPARATUS FOR PREVENTING BED FRAME SQUEAKING

BACKGROUND OF THE INVENTION

1. Field of the Invention

The present invention relates to bed shims and more particularly pertains to affixing bed shim units to various locations on a bed frame to eliminate squeaking and protect wall surfaces.

2. Description of the Prior Art

The use of bed frame and headboard accessories is known in the prior art. More specifically, bed frame and headboard accessories heretofore devised and utilized for the purpose of adapting bed frames and headboards are known to consist basically of familiar, expected and obvious structural configurations, notwithstanding the myriad of designs encompassed by the crowded prior art which have been developed for the fulfillment of countless objectives and requirements.

By way of example, U.S. Pat. No. 3,604,306 to Denholm discloses an adjustable mounting shim.

U.S. Pat. No. 5,163,968 to Lafferty discloses a headboard mounting hardware.

U.S. Pat. No. Des. 285,047 to Dean et al. discloses a headboard bracket.

U.S. Pat. No. 4,232,068 to Hoh et al. discloses a shim.

U.S. Pat. No. 4,467,486 to Schatz discloses a headboard bracket.

U.S. Pat. No. 4,903,354 to Yeh discloses a headboard connection device.

While these devices fulfill their respective, particular objective and requirements, the aforementioned patents do not describe bed shims for affixation to various locations on a bed frame to eliminate squeaking and protect wall surfaces.

In this respect, the bed shims according to the present invention substantially departs from the conventional concepts and designs of the prior art, and in doing so provides an apparatus primarily developed for the purpose of affixing bed shim units to various locations on a bed frame to eliminate squeaking and protect wall surfaces.

Therefore, it can be appreciated that there exists a continuing need for new and improved bed shims which can be used for affixing bed shim units to various locations on a bed frame to eliminate squeaking and protect wall surfaces. In this regard, the present invention substantially fulfills this need.

SUMMARY OF THE INVENTION

In the view of the foregoing disadvantages inherent in the known types of bed frame and headboard accessories now present in the prior art, the present invention provides an improved bed shims. As such, the general purpose of the present invention, which will be described subsequently in greater detail, is to provide a new and improved bed shims and method which has all the advantages of the prior art and none of the disadvantages.

To attain this, the present invention essentially comprises new and improved bed shims adapted for use in association with a bed frame including parallel rails having ends, a head board, a foot board and a plurality of bolts, the apparatus comprising, in combination: a plurality of bed shim units each formed in a planar rectangular configuration, each bed shim unit including flexible front and rear plates fabricated of NEOPRENE and a rigid central plate fabricated of aluminum, each plate having parallel first and second long side edges and parallel short side edges, in an operative orientation the plates being secured together with corresponding side edges in alignment, the front plate having a checkered surface including a plurality of pyramid shaped bumps, the rear plate having a flat surface including a peel-off adhesive backing, each bed shim unit including two circular holes extending through each of the plates, one circular hole being positioned adjacent each short side edge and the first long side edge of each plate, bed shim units being affixed between a headboard and ends of bed frame rails, bed shim units also being positioned at other locations on the bed frame, headboard and foot board, the bed shim units functioning to reduce noise and scratching; a central perforation extending from the center point of the first long side edge to the center point of the second long side edge of each plate, the central perforation permitting a user to divide each bed shim unit into two separate equally sized pieces; and two parallel longitudinal perforations extending between the circular holes of each bed shim unit, the parallel longitudinal perforations defining a generally rectangular area between the circular holes, the generally rectangular area of each bed shim unit adapted to be punched out to define a generally oval shaped hole extending therethrough.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved bed shims which has all the advantages of the prior art bed frame and headboard accessories and none of the disadvantages.

Figure 2:
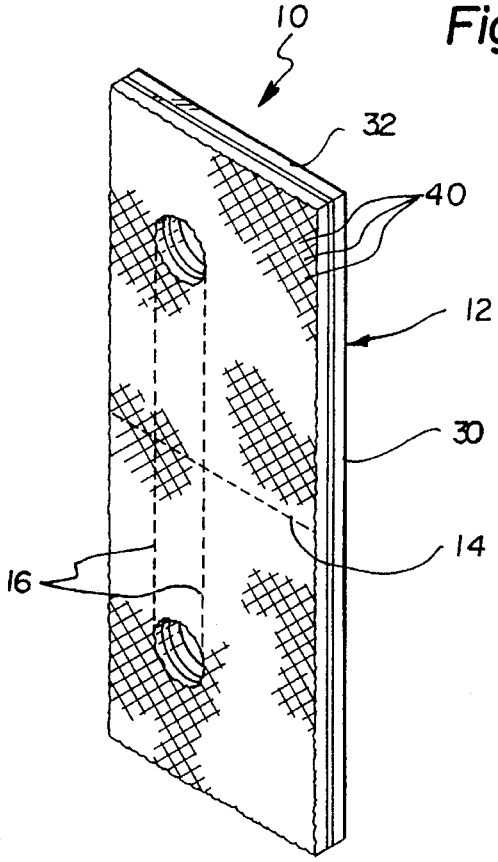
FIG. 2 is an isolated perspective view of a bed shim unit illustrating its checkered front surface.

It is another object of the present invention to provide a new and improved bed shims which may be easily and efficiently manufactured and marketed.

sized pieces. This configuration provides the user with ample flexibility when arranging the units around a bed frame. Note FIG. 2.

Two parallel longitudinal perforations 16 extend between the circular holes of each bed shim unit. The parallel longitudinal perforations define a generally rectangular area between the circular holes. The generally rectangular area of each bed shim unit is adapted to be punched out to define a generally oval shaped hole extending through it. In a punched out orientation a user can couple the individual bed shim units around obstructions such as bolts, screws and ledges. Note FIGS. 2–4.

A second embodiment 50 of the present invention is shown in FIG. 6. This embodiment includes substantially all of the components of the present invention except for the circular holes. The second embodiment includes an oval shaped perforation 52 positioned within it. The oval shaped perforation is adapted to be punched out to define a generally oval shaped hole 54. The second embodiment is affixed to the bed frame in the same manner as the preferred embodiment. Note FIG. 6.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by LETTERS PATENT of the United States is as follows:

1. New and improved apparatus for preventing bed frame squeaking adapted for use in association with a bed frame including parallel rails having ends, a head board, a foot board and a plurality of bolts, the apparatus comprising, in combination:

a plurality of bed shim units each formed in a planar rectangular configuration, each bed shim unit including flexible front and rear plates fabricated of NEOPRENE and a rigid central plate fabricated of aluminum, each plate having parallel first and second long side edges and parallel short side edges, in an operative orientation the plates being secured together with corresponding side edges in alignment, the front plate having a checkered surface including a plurality of pyramid shaped bumps, the rear plate having a flat surface including a peel-off adhesive backing, each bed shim unit including two circular holes extending through each of the plates, one circular hole being positioned adjacent each short side edge and the first long side edge of each plate, bed shim units being affixed between a headboard and ends of bed frame rails, bed shim units also being positioned at other locations on the bed frame, headboard and foot board, the bed shim units functioning to reduce noise and scratching;

a central perforation extending from the center point of the first long side edge to the center point of the second long side edge of each plate, the central perforation permitting a user to divide each bed shim unit into two separate equally sized pieces; and two parallel longitudinal perforations extending between the circular holes of each bed shim unit, the parallel longitudinal perforations defining a generally rectangular area between the circular holes, the generally rectangular area of each bed shim unit adapted to be punched out to define a generally oval shaped hole extending therethrough.

2. Apparatus for preventing bed frame squeaking comprising:

a plurality of bed shim units including flexible front and rear plates and a rigid central plate, the plates being secured together, the rear plate having a flat surface including a peel-off adhesive backing, each bed shim unit including two circular holes extending therethrough; and two parallel longitudinal perforations extending between the circular holes of each bed shim unit, the parallel longitudinal perforations defining a generally rectangular area between the circular holes, the generally rectangular area of each bed shim unit adapted to be punched out to define a generally oval shaped hole extending therethrough.

3. The apparatus for preventing bed frame squeaking as set forth in claim 2 wherein the each bed shim unit includes first and second long side edges, the apparatus further including:

a central perforation extending from the center point of the first long side edge to the center point of the second long side edge of each bed shim unit, the central perforation permitting a user to divide each bed shim unit into two separate equally sized pieces.

4. Apparatus for preventing bed frame squeaking comprising:

a plurality of bed shim units including flexible front and rear plates and a rigid central plate, the plates being secured together, the rear plate having a flat surface including a peel-off adhesive backing, each bed shim unit including an oval shaped perforation positioned therein, the oval shaped perforation adapted to be punched out to define a generally oval shaped hole extending therethrough, each bed shim unit including first and second long side edges; and a central perforation extending from the center point of the first long side edge to the center point of the second long side edge of each bed shim unit, the central perforation permitting a user to divide each bed shim unit into two separate equally sized pieces.

* * * * *